US005338926A

United States Patent [19]

Yoshida

[11] Patent Number: 5,338,926

[45] Date of Patent: Aug. 16, 1994

[54] X-RAY IMAGING TUBE HAVING A LIGHT-ABSORBING PROPERTY

[75] Inventor: Atsuya Yoshida, Ootawara, Japan

[73] Assignee: Kabushiki Kaisha Toshiba, Kawasaki, Japan

[21] Appl. No.: 886,824

[22] Filed: May 22, 1992

[30] Foreign Application Priority Data

May 24, 1991 [JP] Japan ..... 3-120178
May 13, 1992 [JP] Japan ..... 4-120775

[51] Int. Cl.[5] ..... H01J 1/62

[52] U.S. Cl. ..... 250/214 VT; 250/486.1; 313/527

[58] Field of Search ..... 250/214 VT, 483.1, 486.1, 250/487.1; 313/523, 525, 527, 530, 541, 542

[56] References Cited

U.S. PATENT DOCUMENTS

| | | | |
|---|---|---|---|
| 3,089,956 | 5/1963 | Harper | 250/486.1 |
| 3,482,104 | 12/1969 | Finkle | 313/527 |
| 4,398,118 | 8/1983 | Galves et al. | 313/527 |
| 4,479,061 | 10/1984 | Koizumi et al. | 250/487.1 |
| 4,739,172 | 4/1988 | Obata et al. | 250/487.1 |
| 4,803,366 | 2/1989 | Vieux et al. | 250/486.1 |
| 4,950,952 | 8/1990 | Aramaki | 313/542 |
| 4,982,136 | 1/1991 | Dolizy et al. | 313/527 |
| 5,166,512 | 11/1992 | Kubo | 313/527 |

FOREIGN PATENT DOCUMENTS

| | | |
|---|---|---|
| 0283020 | 9/1988 | European Pat. Off. . |
| 54-40071 | 12/1979 | Japan . |
| 59-121733 | 7/1984 | Japan . |
| 59-121737 | 7/1984 | Japan . |
| 62-43046 | 2/1987 | Japan . |

OTHER PUBLICATIONS

Database WPI, Weel 7635, Derwent Publications Ltd., London, GB; AN 76-65736 and JP-A-51 080690.

Yacaman et al, "Growth of Mn203 Thin Films by Impurity Diffusion From Volume to Surface in Impure NaCl Crystals", Journal of Crystal Growth, vol. 7, 1970, pp. 259-261.

*Primary Examiner*—David C. Nelms
*Assistant Examiner*—S. B. Allen
*Attorney, Agent, or Firm*—Cushman, Darby & Cushman

[57] ABSTRACT

An X-ray imaging tube has an input phosphor screen including a substrate, a discontinuous phosphor layer formed on the substrate, and a continuous phosphor layer formed on the discontinuous phosphor layer. The discontinuous phosphor layer consists of a large number of columnar crystals separated from each other and containing a substance for absorbing light emitted from a phosphor upon incidence of an X-ray. Light-absorbing layers containing a compound of the substance and having a concentration of the element higher on outer surfaces thereof than that in interiors thereof are formed on adjacent side surfaces of the columnar crystals such that the light-absorbing layers are not present at an interface between the discontinuous phosphor layer and the continuous phosphor layer. The gap between the adjacent side surfaces of the columnar crystals is 0.1 μm or more.

12 Claims, 5 Drawing Sheets

X-RAY IMAGING TUBE HAVING A LIGHT-ABSORBING PROPERTY

BACKGROUND OF THE INVENTION

1. Field of the Invention

The present invention relates to an X-ray imaging tube having a high resolution.

2. Description of the Related Art

Conventional X-ray imaging tubes have been generally used in a variety of applications as medical X-ray image pickup apparatuses and industrial non-destructive testing X-ray TV monitors.

A conventional X-ray imaging tube comprises a vacuum envelope having an input window for receiving an X-ray. An arcuated substrate is arranged inside the vacuum envelope to oppose the input window. An input phosphor screen and a photocathode are sequentially stacked on the opposite surface of the arcuated substrate with respect to the input window. A focusing electrode is arranged along the inner side wall of the vacuum envelope. An anode and an output phosphor screen are arranged on the output side.

An X-ray emitted from an X-ray tube passes through an object to be examined and then passes through the input window and the substrate of the X-ray imaging tube. The X-ray is then converted into light by the input phosphor screen. This light is converted into electrons by the photocathode. The electrons are accelerated and focused by an electron lens constituted by the focusing electrode and the anode. The focused electrons are converted into a visible image by the output phosphor screen. This visible image is picked up by a television camera, movie camera, or spot camera and is used for medical diagnosis.

An arrangement of the input phosphor screen of the X-ray imaging tube will be described with reference to FIG. 1.

Referring to FIG. 1, the input phosphor screen comprises an aluminum substrate 1, a discontinuous layer 2 made of cesium iodide (CsI) formed on the aluminum substrate 1, a continuous layer 3 made of cesium iodide (CsI) formed on the discontinuous layer 2, and a photocathode 4 formed on the continuous layer 3. The input phosphor screen having the above structure has a light guide effect. That is, since cesium iodide has a refractive index of 1.84 for emission at a wavelength of about 420 nm, light emitted by the cesium iodide crystal is theoretically subjected to total reflection when it is incident on an interface between the crystal and the vacuum at an obtuse angle of 33x or more. For this reason, the light cannot emerge outside the crystal. Part of emission cannot be scattered laterally and reaches the photocathode 4.

The light is attenuated at the interface between the crystal and the vacuum. Light emerging outside the crystal at a critical angle of 33° or less reaches the adjacent discontinuous layer 2. At the time, most of the light is absorbed by the adjacent discontinuous layer 2, but the light partially returns to the original crystal by Fresnel reflection. This applies to emergence of light from the crystal to the vacuum. Light scattered laterally is gradually attenuated. Light farther away from a crystal growth direction passes the interface more frequently, thereby increasing the degree of attenuation. Therefore, light closer to the crystal growth direction can reach the photocathode 4 with a small attenuation amount.

Light emerging from the discontinuous layer 2 reaches the photocathode 4 which is not far away from a light emission point. A resolution of the input phosphor screen itself is thus obtained. Since a recent X-ray imaging tube aims at detecting X-ray signals passing through the object as much as possible, the thickness of the input phosphor screen is set to be 400 μm or more, thereby improving X-ray absorption efficiency.

The light guide effect does not depend on the thickness of the input phosphor screen. When the thickness of the input phosphor screen, however, is increased, a light attenuation effect at the interface between the vacuum and the crystal is weakened, and the resolution of the input phosphor screen is decreased.

In order to increase this resolution, it is possible to reduce the diameter of each columnar crystal of the discontinuous layer 2 to obtain a dense optical interface in the planar direction. It is assumed that the dense optical interface increases the light attenuation rate (per unit optical length) of the laterally scattered light.

The diameter of each columnar crystal of the discontinuous layer 2 depends on the substrate temperature in a screen deposition process. When a cesium iodide film was formed at a pressure of 0.45 Pa while the substrate temperature was maintained at 150° C. during deposition, a discontinuous layer 2 of columnar crystals each having a diameter of 6 μm was obtained. When the substrate temperature was set at 180° C., a discontinuous layer 2 of columnar crystals each having a diameter of 9 μm was obtained. When the resolutions of input phosphor screens having these discontinuous layers 2 were measured, CTF (Contrast Transfer Function) values of these samples were almost equal to each other, about 24% at 20 lp/cm. The CTF value of the input phosphor screen having the discontinuous layer of columnar crystals each having the diameter of 6 μm was larger than that of the columnar crystals each having the diameter of 9 μm by 1% at 50 lp/cm. This CTF difference results in a small difference appearing on the TV monitor through an image pickup system when the input phosphor screen is mounted in an X-ray imaging tube.

As another effective means for improving resolution characteristics of an input phosphor screen having such a columnar structure, a light-absorbing or light-reflecting layer is formed at the optical interface constituted by the columnar structure, thereby increasing the lateral light attenuation. In particular, a method of increasing light attenuation at the interface between the crystal and the vacuum is disclosed in Published Unexamined Japanese Patent Application No. 62-43046. According to this method, a light-absorbing layer is formed between the crystal columns of the discontinuous layer. Another method is disclosed in Published Unexamined Japanese Patent Application No. 59-121733, in which a light-reflecting material powder is filled between the columns of the discontinuous layer. However, since the gap between the columns of the discontinuous layer is 1 μm, it is very difficult to perform the above process in the small gap between the crystal columns.

To the contrary, Published Examined Japanese Patent Application No. 54-40071 describes that a columnar phosphor mixed with copper is annealed in an oxygen atmosphere to form an oxide film at the optical interface of the columnar phosphor, thereby obtaining an input phosphor screen. This prior art describes that light within the phosphor is reflected by the oxide film on the input phosphor screen and will not emerge outside the phosphor.

SUMMARY OF THE INVENTION

The present invention has been made in consideration of the above situation, and has as its object to provide an X-ray imaging tube, in which lateral light scattering from a columnar crystal of a phosphor can be suppressed to increase the resolution.

It is another object of the present invention to provide a method of manufacturing an X-ray imaging tube, in which lateral light scattering from a columnar crystal of a phosphor can be suppressed to increase the resolution.

It is still another object of the present invention to provide an X-ray photographic apparatus having a high resolution.

According to the present invention, there is provided an X-ray imaging tube comprising an input phosphor screen which includes a substrate, a discontinuous phosphor layer formed on the substrate, and a continuous phosphor layer formed on the discontinuous phosphor layer, wherein the discontinuous phosphor layer comprises a large number of columnar crystals separated from each other and containing a substance for absorbing light emitted from a phosphor upon incidence of an X-ray, light-absorbing layers containing a compound of the substance and having a concentration of the substance higher on outer surfaces thereof than that in interiors thereof are formed on adjacent side surfaces of the columnar crystals, the light-absorbing layers are not present at an interface between the discontinuous phosphor layer and the continuous phosphor layer, and a gap between the adjacent side surfaces of the columnar crystals is not less than 0.1 μm.

According to the present invention, there is also provided a method of manufacturing an X-ray imaging tube, comprising the steps of: forming a discontinuous phosphor layer on a substrate, the discontinuous phosphor layer containing a substance for absorbing light emitted from a phosphor upon incidence of an X-ray and being constituted by a large number of columnar crystals separated from each other so that a gap between adjacent side surfaces of the columnar crystals falls within a range of 0.1 to 40 μm; forming a continuous phosphor layer on the discontinuous phosphor layer; and heat-treating the continuous and discontinuous phosphor layers at 60° C. to 380° C. to form light-absorbing layers on the adjacent side surfaces of the columnar crystals, the light-absorbing layers containing a compound of the substance and having a concentration of the substance higher on outer surfaces thereof than that in interiors thereof.

According to the present invention, there is also provided an X-ray photographic apparatus comprising X-ray generating means for generating an X-ray emitted onto an object to be examined, an X-ray grid for eliminating scattered light from the X-ray emitted from the X-ray generating means onto the object and transmitted through the object, an X-ray imaging tube for converting an X-ray fluoroscopic image having passed through the X-ray grid into a visible image, and means for picking up or printing the visible image, wherein the X-ray imaging tube comprises an input phosphor screen which includes a substrate, a discontinuous phosphor layer formed on the substrate, and a continuous phosphor layer formed on the discontinuous phosphor layer, the discontinuous phosphor layer comprises a large number of columnar crystals separated from each other and containing a substance for absorbing light emitted from a phosphor upon incidence of an X-ray, light-absorbing layers containing a compound of the substance and having a concentration of the substance higher on outer surfaces thereof than that in interiors thereof are formed on adjacent side surfaces of the columnar crystals, the light-absorbing layers are not present at an interface between the discontinuous phosphor layer and the continuous phosphor layer, and a gap between the adjacent side surfaces of the columnar crystals is not less than 0.1 μm.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An X-ray imaging tube according to the present invention will be described in detail with reference to the accompanying drawings.

Figure 1:
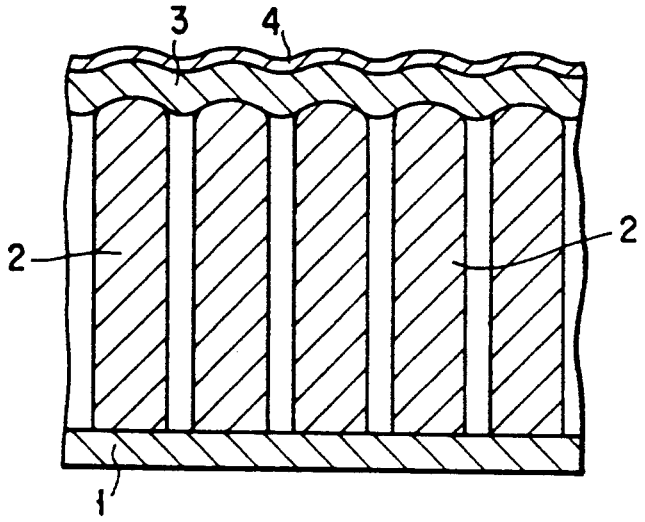
PRIOR ART F I G. 1
FIG. 1 is a sectional view showing an input phosphor screen of a conventional X-ray imaging tube.
Figure 2:
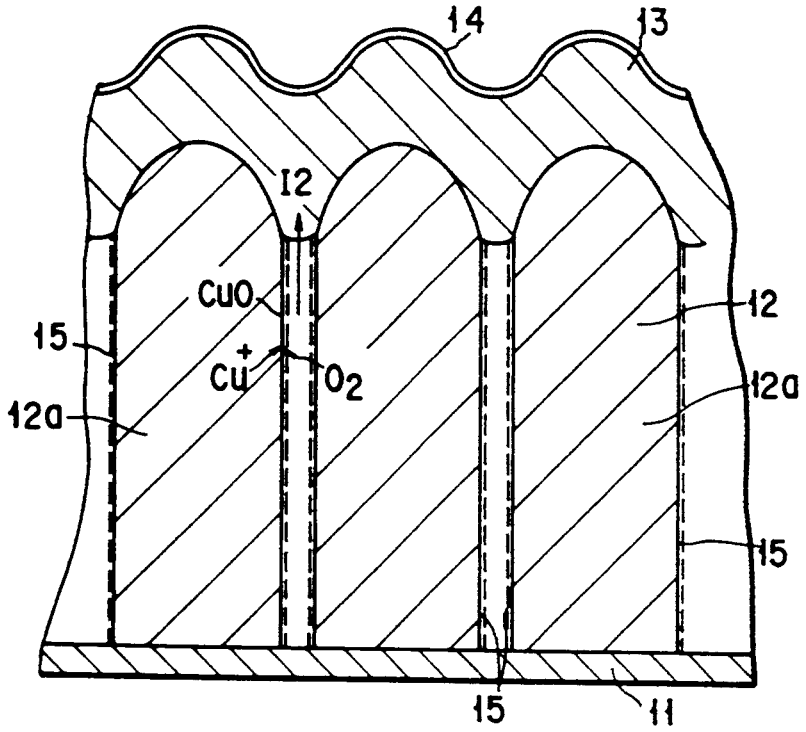
FIG. 2 is a sectional view of an input phosphor screen of an X-ray imaging tube according to the present invention.

FIG. 2 is a sectional view showing part of an input phosphor screen of an X-ray imaging tube according to an embodiment of the present invention. Referring to FIG. 2, a discontinuous phosphor layer 12 discontinuous in a planar direction and comprising a large number of columnar crystals **12*a* consisting of cesium iodide is formed on an aluminum substrate 11. A continuous phosphor layer 13 made of cesium iodide is formed on the discontinuous phosphor layer 12. A photoelectric surface 14 is formed on the continuous phosphor layer 13**.

Each columnar crystal **12*a* of the discontinuous phosphor layer 12 contains copper (Cu) in the form of copper iodide in an average concentration of 0.1 wt % or less, and more preferably 0.01 to 0.1 wt %. A gap is present between the adjacent columnar crystals 12*a***.

Black films 15 made of copper oxide (CuO) as an oxide of copper are formed on the surfaces of the adjacent columnar crystals 12*a* defining the gap. Note that no black film 15 is formed on the upper surface of each columnar crystal 12*a* which contacts the continuous phosphor layer 13. The black film 15 constitutes an optical interface with the gap.

Copper is more active to oxygen than the major constituent of the phosphor, such as sodium-activated cesium iodide (CsI:Na). Copper can more effectively absorb light from the phosphor in the form of an oxide outside the crystals than in the form of ions within the columnar crystals 12*a*.

The gap between the adjacent columnar crystals 12*a*, i.e., the gap between the optical interface preferably falls within the range of 0.1 to 40 μm, and more preferably 0.1 to 3 μm. The diameter of the columnar crystal 12*a* preferably falls within the range of 40 μm or less, and more preferably 5 to 15 μm.

Figure 3:
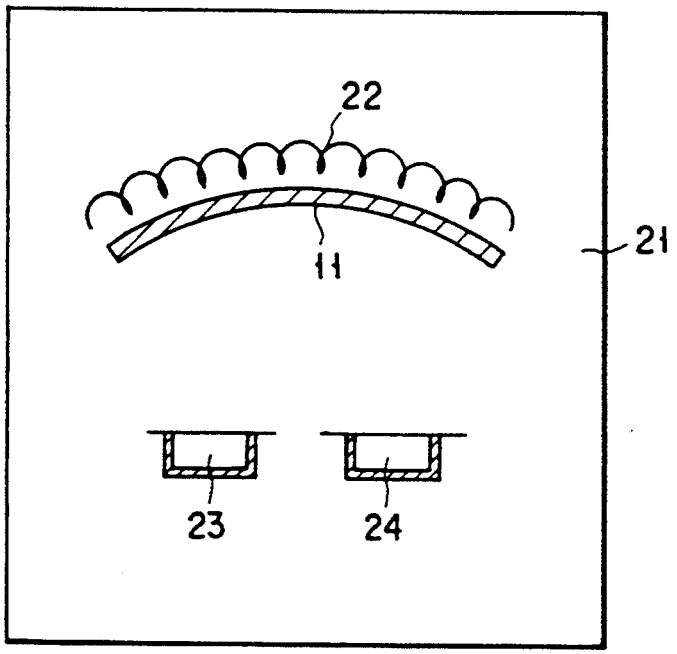
FIG. 3 is a schematic view showing a vacuum deposition apparatus for forming the input phosphor screen.

FIG. 3 is a view showing the schematic arrangement of an apparatus for manufacturing the input phosphor screen. Referring to FIG. 3, an aluminum substrate 11 is located inside a vacuum tank 21. A heater 22 is located above the aluminum substrate 11, and first and second boats 23 and 24 are located below the aluminum substrate 11. Cesium iodide (CsI) containing 0.02 wt % of copper iodide (CuI) and a small amount of sodium iodide (NaI) are contained in the first boat 23. Cesium iodide (CsI) and a small amount of sodium iodide (NaI) are contained in the second boat 24.

Formation of the discontinuous phosphor layer 12 and the continuous phosphor layer 13 on the aluminum substrate 11 is performed using the apparatus shown in FIG. 3 in the following manner.

The aluminum substrate 11 is heated to 180° C. by the heater 22. The first boat 23 is heated while the pressure of the vacuum tank is kept at $4.5\times10^{-1}$ Pa to form a discontinuous phosphor layer 12 having a thickness of 380 μm and a columnar crystal structure on the aluminum substrate 11 . The second boat 24 is heated while the aluminum substrate 11 is kept heated at 180° C. and the pressure in the vacuum tank 21 is kept at $10^{-3}$ Pa, thereby forming a continuous phosphor layer 13 on the aluminum substrate 11. The thickness of the continuous phosphor layer 13 is about 20 μm. Thereafter, the aluminum substrate 11 having the discontinuous phosphor layer 12 and the continuous phosphor layer 13 thereon is exposed to the air and is heated at 280° C. for 5 hours.

The average diameter of the columnar crystals 12*a* of the resultant discontinuous phosphor layer 12 was 12 fm, and the gap between the optical interfaces of the adjacent columnar crystals 12*a* was 0.3 to 1 μm.

Since cesium iodide (CsI) as the major constituent of the phosphor-layers of the input phosphor screen described above are ionic crystals, cesium ions ($Cs^+$) and iodine ions ($I^-$) in the lattice can be easily substituted with ions of another chemical species. Therefore, small amounts of thallium ions ($Tl^+$) and sodium ions ($Na^+$) added to improve luminous efficacy in the input phosphor screen can be substituted with cesium ions as follows:

$$-I^--Cs^+-I^-- \xrightarrow{Tl^+,\ Na^+} \begin{array}{l} -I^--Tl^+-I^-- \\ -I^--Na^+-I^-- \end{array}$$

When this nature is utilized, light-absorbing materials! can be mixed in the columnar crystals 12*a* of the discontinuous phosphor layer 12 while the crystal lattice is maintained. This can be achieved even by multivalent ions. When the amount of light-absorbing materials is small, the physical properties of the phosphor itself of the discontinuous phosphor layer 12 are not impaired. For example, when divalent iron ($Fe^{++}$) is to be mixed in a phosphor, it is substituted with a cesium ion as follows:

$$-I^--Cs^+-I^--Cs^+-I- \xrightarrow{Fe^{++}} -I^--Fe^{++}-I^--\boxed{+}-I^--$$

$\boxed{+}$ : cationic hole

In this manner, a crystal mixed with ions of a given chemical species has light-absorbing characteristics which cannot be obtained by pure cesium iodide (CsI) or cesium iodide (CsI) mixed with only thallium ions ($Tl^+$) and sodium ions ($Na^+$). That is, an input phosphor screen which is originally almost transparent to light emission has a smaller transmittance. For this reason, light directed farther away from the crystal direction of the discontinuous phosphor layer 12 has a longer distance to reach the photocathode 14, thereby increasing the light attenuation. In other words, when the input phosphor screen has a smaller transmittance, light reaching the photocathode 14 at a position away from a light emission point is increased, so that the resolution of the input phosphor screen is increased.

A greater effect can be obtained by selecting a substance which exhibits a greater light absorption capability when contained in the crystal in the form of an oxide than when contained in the form of an ion.

Some of the emitted light rays are subjected to total reflection at the optical interface noted above so as to arrive at the photocathode without running out of the crystal. The particular light rays constitute a factor for improving MTF. The particular substances include, for example, copper. In the case of a monovalent copper iodide, copper is incorporated into the crystal as follows.

$$-I^--Cs^+-I^--Cs^+-I \xrightarrow{Cu^+} I^--Cu-I^--Cs^+-I^--$$

In order to obtain cesium iodide (CsI) mixed with monovalent copper ($Cu^+$), a powder mixture obtained by mixing a copper iodide powder in a cesium iodide (CsI) powder may be vacuum-deposited.

Since copper ions ($Cu^+$) are more active to oxygen ($O_2$) than the cesium ions ($Cs^+$) and the iodine ions ($I^-$) constituting the phosphor, the copper ions can be easily oxidized by heating in air. This oxidation reaction is performed by the following formulas:

$$2CuI+O_2\rightarrow 2CuO+I_2\uparrow$$

$$4CuI+O_2\rightarrow 2Cu_2O+2I_2\uparrow$$

In the above oxidation reaction, a larger amount of oxygen is supplied to the optical interface between the columnar crystals 12*a* than to the interiors thereof. For this reason, the oxidation reaction progresses mainly at the optical interface. When the oxidation reaction near the surface of the columnar crystals 12*a* progresses, copper ions near the surface become deficient. However, since copper ions in the bulk crystal are diffused by heating and are replenished near the surface, the reaction progresses further. The black film 15 made of copper oxide (CuO) having a higher concentration toward the surface of each columnar crystal 12*a*, i.e., a portion closer to the optical interface is formed.

It should be noted that impurity ions present within the crystal also provide a negative factor impairing the quantum yield of the phosphor. Naturally, it is important to carry out the oxidizing reaction sufficiently so as to release the impurities out of the crystal, whether or not the impurity ions may be capable of absorbing light. It follows that, in studying this process, it is important to determine the conditions under which a sufficient reaction rate can be obtained.

Figure 4:
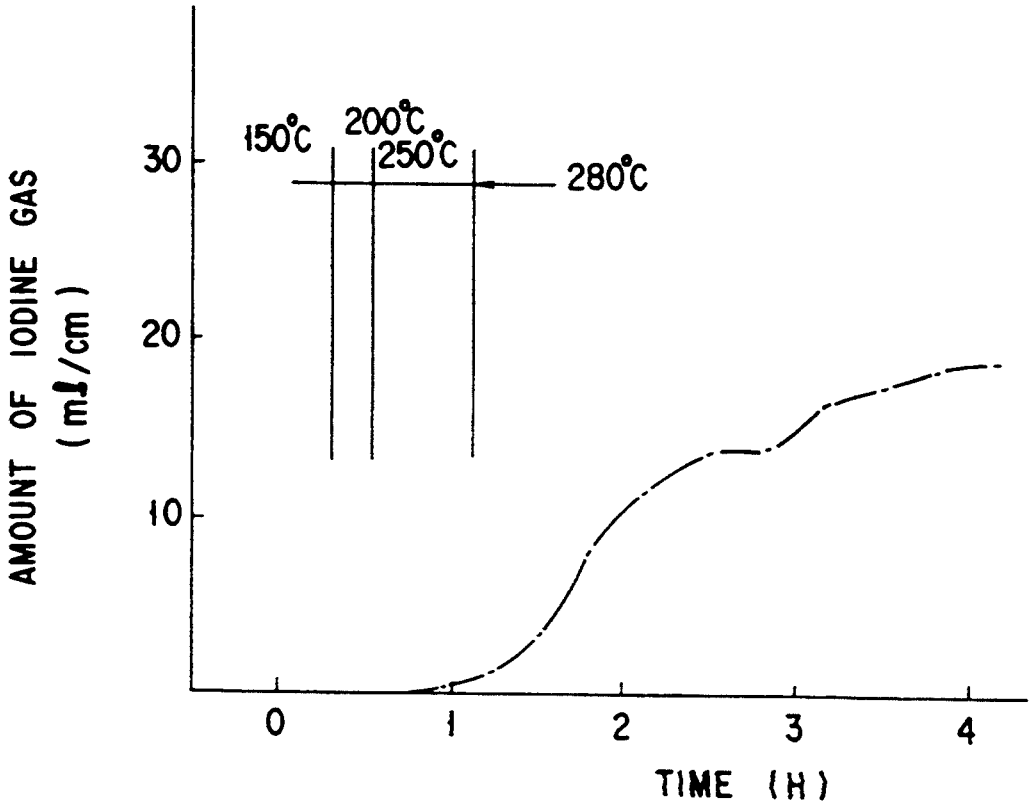
FIG. 4 is a graph showing a total amount of iodine gas during formation of copper oxide produced by oxidizing copper iodide.

A temperature for obtaining a sufficiently high reaction temperature for causing a reaction to form the black film 15 can be obtained by monitoring the amount of iodine gas ($I_2$) produced by oxidizing copper iodide to form copper oxide. More specifically, in the graph shown in FIG. 4, time is plotted along the abscissa, the total amount of iodine gas is plotted along the ordinate, and measurement values are plotted in the graph. When the temperature is increased to a maximum of 280° C., the amount of produced iodine gas increases abruptly. Therefore, 280° C. is a sufficiently high temperature which can cause the oxidation reaction.

Precipitation of an impurity from a crystal in an oxygen atmosphere by heating is described in "Journal of Crystal Growth 7 (1970), GROWTH OF $Mn_2O_3$ THIN FILM BY IMPURITY DIFFUSION FROM VOLUME TO SURFACE IN IMPURE NaCl CRYSTAL, PP. 259–260" or the like.

In this embodiment, a powder mixture obtained by mixing a copper iodide power in a cesium iodide (CsI) powder is vacuum-deposited to form the discontinuous phosphor layer 12 comprising the columnar crystals 12*a*. Subsequently, the cesium iodide (CsI) powder is deposited to form the continuous phosphor layer 13, and then the resultant structure is heated in air at 280° C. for 5 hours, thereby easily forming the black film 15 made of copper oxide (CuO) having a high concentration on the columnar crystals 12*a* at the optical interface. In this case, since the surface of each columnar crystal 12*a* which contacts the continuous phosphor layer 13 is not exposed to the air, the black film 15 made of copper oxide (CuO) having a high concentration is not formed on this surface.

The relationship between the heating conditions, the crystal size, and the precipitation state of the impurity on the crystal surface is described in Revista Mexican de Fisica 30 (4) (1984), PP. 685–692. According to this paper, when the heating time is defined as t and the crystal size is defined as l, $t/l^2$ becomes a parameter representing the precipitation progress. In other words, when the crystal size is increased to n times, the heating time required for precipitating the impurity on the crystal surface must be $n^2$ because the distance required for causing the impurity in the crystal to reach its surface is increased.

Judging from the above consideration, when the diameter of each columnar crystal 12*a* constituting the discontinuous phosphor layer 12 is large, an extremely long heating time is required. When the heating time is prolonged, mass-productivity is degraded, and crystals are deformed by heat. In practice, columnar crystals 12*a* having various diameters were formed. When the diameter of the columnar crystal 12*a* exceeded 50 μm the amount of a CuO black film was extremely reduced by heating for 24 hours.

When the above facts are taken into consideration, the heating temperature in air preferably falls within the range of 60° to 350° C., and more preferably 260° to 300° C. The heating time is preferably 24 hour or less, and more preferably 3 to 5.

The gap between the adjacent columnar crystals 12*a* at the optical interface serves as an oxygen supply source during heating. If this gap is excessively small, the amount of oxygen during heating becomes deficient, and the reaction rate becomes low. In actually manufactured films, they had gaps of 0.3 μm or more, thus posing no problems. However, if the gap is smaller than 0.1 μm, it is difficult to form even an oxide film having a thickness of several tens of Å.

In order to examine the effect of the present invention, six input phosphor screen samples were manufactured, and their CTF curves were obtained.

Sample A: an input phosphor screen obtained such that an input phosphor screen having a discontinuous phosphor layer made of sodium-activated cesium iodide (CsI:Na) and a continuous phosphor layer was heated in a vacuum at 260° C. (no heating in air was performed after the continuous phosphor layer was formed).

Sample B: an input phosphor screen vacuum-heated at 260° C. and having a discontinuous phosphor layer made of sodium-activated cesium iodide (CsI:Na) containing 0.02 wt % of copper iodide and a continuous phosphor layer (no heating in air was performed).

Sample C: an input phosphor screen obtained such that an input phosphor screen having a discontinuous phosphor layer made of sodium-activated cesium iodide (CsI:Na) containing 0.02 wt % of copper iodide and a continuous phosphor layer was formed as in the above embodiment and was heated in a vacuum at 260° C. (heating in air was performed at 280° C. for 5 hours after the continuous phosphor layer was formed).

Heating in a vacuum at 260° C. was performed to activate the phosphors.

Figure 5:
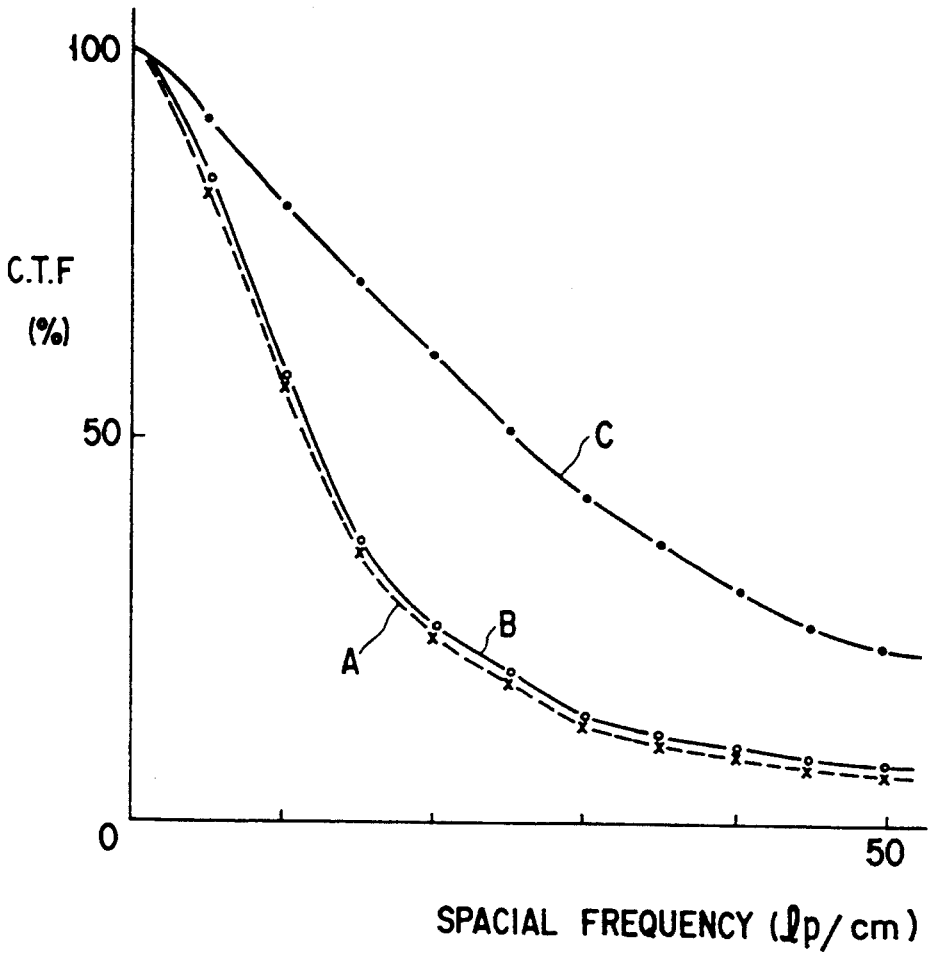
FIG. 5 is a graph showing comparison between CTF curves between the conventional input phosphor screen and the input phosphor screen of the present invention.

CTF curves of all the samples are shown in FIG. 5.

Referring to FIG. 5, the CTF curves (curve C) of sample C exhibits better results than those of the CTF curves (curves A and B) of samples A and B.

Light emission amounts of all the samples were measured. The light emission amount of sample C was about 36% that of sample A, and the light emission amount of sample B was greatly reduced to be about 29% that of sample A due to the following reasons. Although the discontinuous phosphor layer of sample C contains copper, most of it is present in the form of copper oxide near the optical interface, and the amount of copper in the columnar crystals in the bulk is small. Therefore, light emission of the phosphor is not much interfered. However, in the discontinuous phosphor layer of sample B, a large number of copper ions are present in the columnar crystals of the bulk, thereby interfering light emission of the phosphor.

Figure 6:
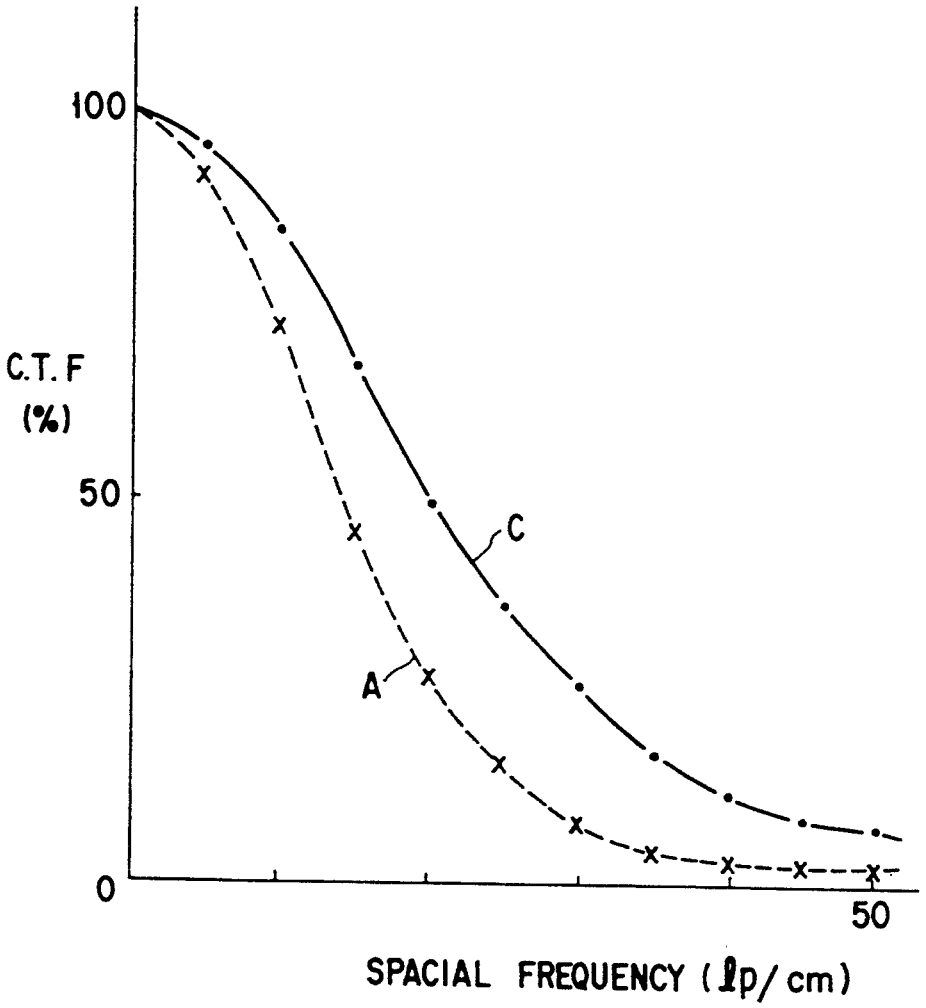
FIG. 6 is a graph showing comparison between CTF curves of the conventional X-ray imaging tube and the X-ray imaging tube of the present invention.

The above results are obtained when the CTF curves of the input phosphor screen themselves are obtained. The input phosphor screens of samples A and C were respectively mounted in X-ray imaging tubes each having a 9" input view field and an output diameter of 25 mm. CTF curves of these X-ray imaging tubes were obtained, and results are shown in FIG. 6. Judging from the graph in FIG. 6, the CTF curve (curve C) of the X-ray imaging tube comprising the input phosphor screen of sample C exhibits better results than that of the CTF curve (curve A) of the X-ray imaging tube comprising the input phosphor screen of sample A.

Luminances ((cd/m$^2$)/(mR/sec)) of these two X-ray imaging tubes were measured. The luminance of the X-ray imaging tube comprising the input phosphor screen of sample C was lower than that of the X-ray imaging tube comprising the input phosphor screen of sample A. This decrease in luminance can be prevented to some extent by decreasing the concentration of copper mixed in the phosphor. Since the X-ray imaging tube according to the present invention does not have a copper oxide film between the discontinuous phosphor layer and continuous phosphor layer of the input phosphor screen, a decrease in luminance can be prevented.

Sufficiently high transparency can be obtained when about 0.02 wt % of copper iodide are mixed as in the above embodiment. A capability for extracting a maximum number of effective signals from incident X-ray signals is rarely degraded.

In the above description, copper is used as a light-absorbing material mixed in the phosphor constituting the discontinuous phosphor layer. However, the present invention is not limited to copper. Any light-absorbing material such as iron, chromium, manganese, strontium, or mercury can be used if it is contained as ions in the crystal lattice of the phosphor (CsI) and an oxide film can be formed by a heat treatment in an atmosphere containing oxygen.

Note that a heat-treatment atmosphere is not limited to the atmosphere containing oxygen such as air, but can be replaced with an atmosphere containing nitrogen such as nitrogen gas or ammonia gas. When the heat treatment is performed in the atmosphere containing nitrogen, chromium or iron can be used as light-absorbing materials. In this case, nitride films of these materials are formed.

Figure 7:
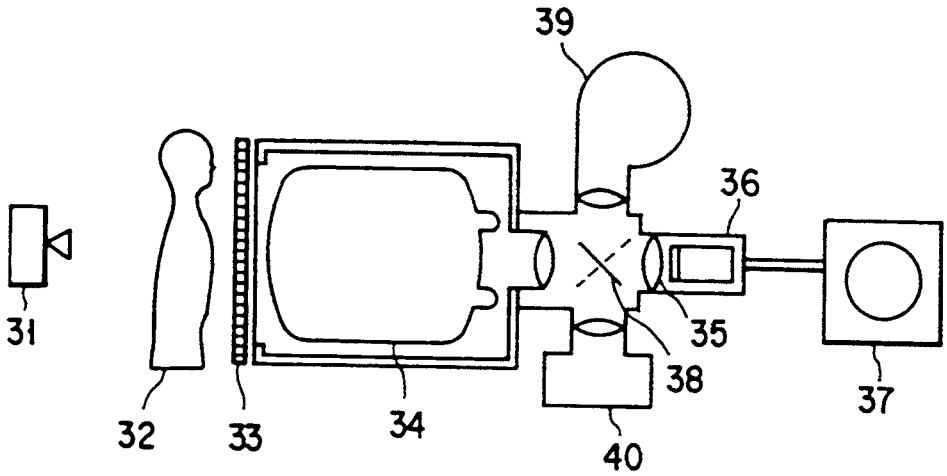
FIG. 7 is a view showing an example of X-ray photographic system.

The X-ray imaging tube described above can be used together with an X-ray tube and an image pickup apparatus to constitute an X-ray photographic system. FIG. 7 is a view showing a fluoroscopic/indirect photographic type X-ray photographic system.

Referring to FIG. 7, an X-ray is emitted from an X-ray tube 31 onto an object 32 to be examined. The X-ray passes through the object 32 to form an X-ray fluoroscopic image. This X-ray fluoroscopic image passes through an X-ray grid 33, so that scattered X-rays are eliminated. The resultant X-ray is incident on an X-ray imaging tube (X-ray image intensifier) 34. The X-ray fluoroscopic image is converted into a visible image by the X-ray imaging tube 34. If this system is a fluoroscopic system, the visible image passes through a TV lens 35 and is picked up by a TV camera 36. As a result, an X-ray fluoroscopic image is output to a TV monitor 37. However, when this system is an indirect photographic system, 90% of the total light amount of the image are supplied to a movie camera 39 through a half mirror 38, and the remaining 10% light amount is supplied to the TV camera 36 to output the X-ray fluoroscopic image on the TV monitor 37. In another case, the half mirror is reversed so that 90% light is supplied to a spot camera 40, so that the X-ray fluoroscopic image is printed on a roll or cut film.

As described above, since the X-ray imaging tube can be combined with a high-sensitivity image pickup element to constitute an X-ray photographic system (FIG. 7) having an S/N ratio equal to that of the conventional system and a high resolution.

As has been described above, according to the X-ray imaging tube of the present invention, since the light-absorbing layers having a higher concentration of a light-absorbing element on the outer surfaces thereof than that in the interiors and containing a compound of this element are formed on the side surfaces of the adjacent columnar crystals of the phosphor constituting the input phosphor screen, lateral light scattering can be suppressed, and the resolution can be increased. In addition, since no light-absorbing layer is formed on the surface of each columnar crystal which contacts the continuous phosphor layer, the luminous efficacy and luminance are not greatly decreased.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An X-ray image intensifier comprising:

an input phosphor screen which includes a substrate, a discontinuous phosphor layer formed on said substrate, and a continuous phosphor layer formed on said discontinuous phosphor layer, said discontinuous phosphor layer comprising:

a plurality of columnar crystals separated from each other and containing a substance for absorbing light emitted from a phosphor upon incidence of an X-ray, light absorbing layers containing a compound of said substance and having a concentration of said substance higher on outer surfaces thereof than that in interiors thereof being integrally formed on adjacent side surfaces of said columnar crystal, said light-absorbing layers are not present at an interface between said discontinuous phosphor layer, said light-absorbing layer comprising one of an oxide layer and a nitride layer which is formed by heat-treating said continuous and discontinuous phosphor layer in an atmosphere of one of oxygen and nitrogen, and a gap between said adjacent surfaces of said columnar crystals is no less than 0.1 μm.

2. A tube according to claim 1, wherein the gap between said adjacent side surfaces of said columnar crystals falls within a range of 0.1 to 40 μm.

3. A tube according to claim 1, wherein the gap between said adjacent side surfaces of said columnar crystals falls within a range of 0.1 to 3 μm.

4. A tube according to claim 1, wherein each of said columnar crystals has a diameter of not more than 40 μm.

5. A tube according to claim 1, wherein each of said columnar crystals has a diameter falling within a range of 5 to 15 μm.

6. A tube according to claim 1, wherein said substance is at least one element selected from the group consisting of copper, iron, chromium, manganese, strontium, and mercury.

7. A tube according to claim 1, wherein said substance is at least one element selected from the group consisting of copper, iron, chromium, manganese, strontium, and mercury, and said compound is an oxide.

8. A tube according to claim 1, wherein said substance is at least one element selected from the group consisting of copper, iron, chromium, manganese, strontium, and mercury, and said compound is a nitride.

9. A tube according to claim 1, wherein said substance is copper and said compound is copper oxide.

10. A tube according to claim 9, wherein the copper in the columnar crystals has a concentration falling within a range of 0.005 to 5 wt %.

11. A tube according to claim 1, wherein said phosphor is activated with sodium and/or thallium.

12. An X-ray photographic apparatus comprising X-ray generating means for generating an X-ray emitted onto an object to be examined, an X-ray grid for eliminating scattered light from the X-ray emitted from said X-ray generating means onto the object and transmitted through the object, an X-ray imaging tube for converting an X-ray fluoroscopic image having passed through said X-ray grid into a visible image, and means for picking up or printing the visible image, wherein said X-ray imaging tube comprises an input phosphor screen constituted by a substrate, a discontinuous phosphor layer formed on said substrate, and a continuous phosphor layer formed on said discontinuous phosphor layer, so that said discontinuous phosphor layer comprises a large number of columnar crystals separated from each other and containing a substance for absorbing light emitted from a phosphor upon incidence of an X-ray, light-absorbing layers containing a compound of said substance and having a concentration of said substance higher on outer surfaces thereof than that in interiors thereof are formed on adjacent side surfaces of said columnar crystals such that said light-absorbing layers are not present at an interface between said discontinuous phosphor layer and said continuous phosphor layer, and a gap between said adjacent side surfaces of said columnar crystals is not less than 0.1 $\mu$m.

* * * * *